US008292370B1

(12) United States Patent
Hygh

(10) Patent No.: US 8,292,370 B1
(45) Date of Patent: Oct. 23, 2012

(54) STOOL ASSEMBLY

(76) Inventor: Edmund Hygh, Laguna Hills, CA (US)

( * ) Notice: Subject to any disclaimer, the term of this patent is extended or adjusted under 35 U.S.C. 154(b) by 0 days.

(21) Appl. No.: 12/927,082

(22) Filed: Nov. 6, 2010

(51) Int. Cl.
*A47C 3/18* (2006.01)
*A63G 9/10* (2006.01)

(52) U.S. Cl. ..... 297/461; 297/181

(58) Field of Classification Search ..... 297/344.21, 297/461, 175, 181, 195.11
See application file for complete search history.

(56) References Cited

U.S. PATENT DOCUMENTS

| | | | | |
|---|---|---|---|---|
| 163,623 | A * | 5/1875 | Allen | 297/461 |
| D16,405 | S | 12/1885 | Clark | |
| 3,593,954 | A * | 7/1971 | Ritchie et al. | 248/215 |
| 4,676,551 | A * | 6/1987 | McDowell | 297/423.41 |
| D352,180 | S | 11/1994 | Collings | |
| D355,773 | S | 2/1995 | MacOwan | |
| 5,439,269 | A * | 8/1995 | Cheng | 297/440.1 |
| D371,682 | S | 7/1996 | Collings | |
| D377,430 | S | 1/1997 | Hopwood | |
| D477,718 | S | 7/2003 | Vail | |
| 6,585,315 | B1 | 7/2003 | Vail | |
| 6,695,407 | B1 * | 2/2004 | Lin | 297/423.38 |
| D493,625 | S | 8/2004 | Elliott | |
| 6,773,070 | B2 * | 8/2004 | Worledge et al. | 297/344.21 |
| D500,606 | S | 1/2005 | Knapp | |
| 6,945,597 | B1 * | 9/2005 | Brown et al. | 297/188.1 |
| D535,828 | S | 1/2007 | Casca Burges | |
| 7,219,956 | B2 | 5/2007 | Zhang | |
| 7,234,781 | B2 * | 6/2007 | Liao | 297/461 |
| D579,677 | S | 11/2008 | Zhou | |
| D591,537 | S | 5/2009 | Zhang | |
| 2002/0163231 | A1 | 11/2002 | Hoshino | |
| 2003/0151291 | A1 * | 8/2003 | Lin et al. | 297/423.38 |
| 2005/0073182 | A1 * | 4/2005 | Brown | 297/181 |
| 2008/0093909 | A1 * | 4/2008 | Deng | 297/440.15 |

* cited by examiner

*Primary Examiner* — Milton Nelson, Jr.
(74) *Attorney, Agent, or Firm* — Dennis W. Beech

(57) ABSTRACT

The present invention may be used for attachment of a variety of seats and legs. A bracket may have a generally circular metal plate with bolt holes for receipt of bolts of a rotatable seat element. A seat mounting plate may be positioned above the circular metal plate on a support beam. The rotatable seat element may be attached by the bolts and fasteners to the bracket and to the top of a central pedestal by a central shaft. A plurality of legs may be attached to a middle portion and a bottom portion of the central pedestal. A generally annular footrest may be arranged around the central pedestal and attached to a second edge of the legs that are splayed outwardly and generally equidistant radially from the central pedestal.

10 Claims, 4 Drawing Sheets

STOOL ASSEMBLY

BACKGROUND OF THE INVENTION

This invention relates to stools that may be used for multiple purposes such as sitting at a bar, food counter, or elevated eating surfaces, sitting at a work table or desk, or at like generally horizontal platforms. The new stool is structured for attachment of a variety of seats and legs.

Stools may be known that swivel or rotate the seat element. The rotational element of such stools are usually simple devices that may or may not have some type of bearing element and because of structural simplicity may be prone to failure. Often the seat of a stool has a round rod attached to the bottom of the seat frame and the rod is inserted into a sleeve or cylinder to allow rotation. Stool structures may not have brackets designed for mounting a variety of seat shapes as for example a saddle seat of a motorcycle. There may also be stools that have artistic designed legs; however, the stool structure may not allow use of a variety of leg designs when assembling the stool. It is desirable to have stool structures that allow attachment of a variety of seat and leg designs.

SUMMARY OF THE INVENTION

The present invention is directed to stools structured for attachment of a variety of seats and legs. A bracket may have a generally circular metal plate with bolt holes for receipt of bolts of a rotatable seat element. A seat mounting plate may be positioned above the circular metal plate on a support beam. The rotatable seat element may be attached by the bolts and fasteners to the bracket and to the top of a central pedestal by a central shaft. A plurality of legs may be attached to a middle portion and a bottom portion of the central pedestal. A generally annular footrest may be arranged around the central pedestal and attached to a second edge of the legs that are splayed outwardly and generally equidistant radially from the central pedestal.

These and other features, aspects and advantages of the present invention will become better understood with reference to the following drawings, description and claims.

DETAILED DESCRIPTION

Figure 1:
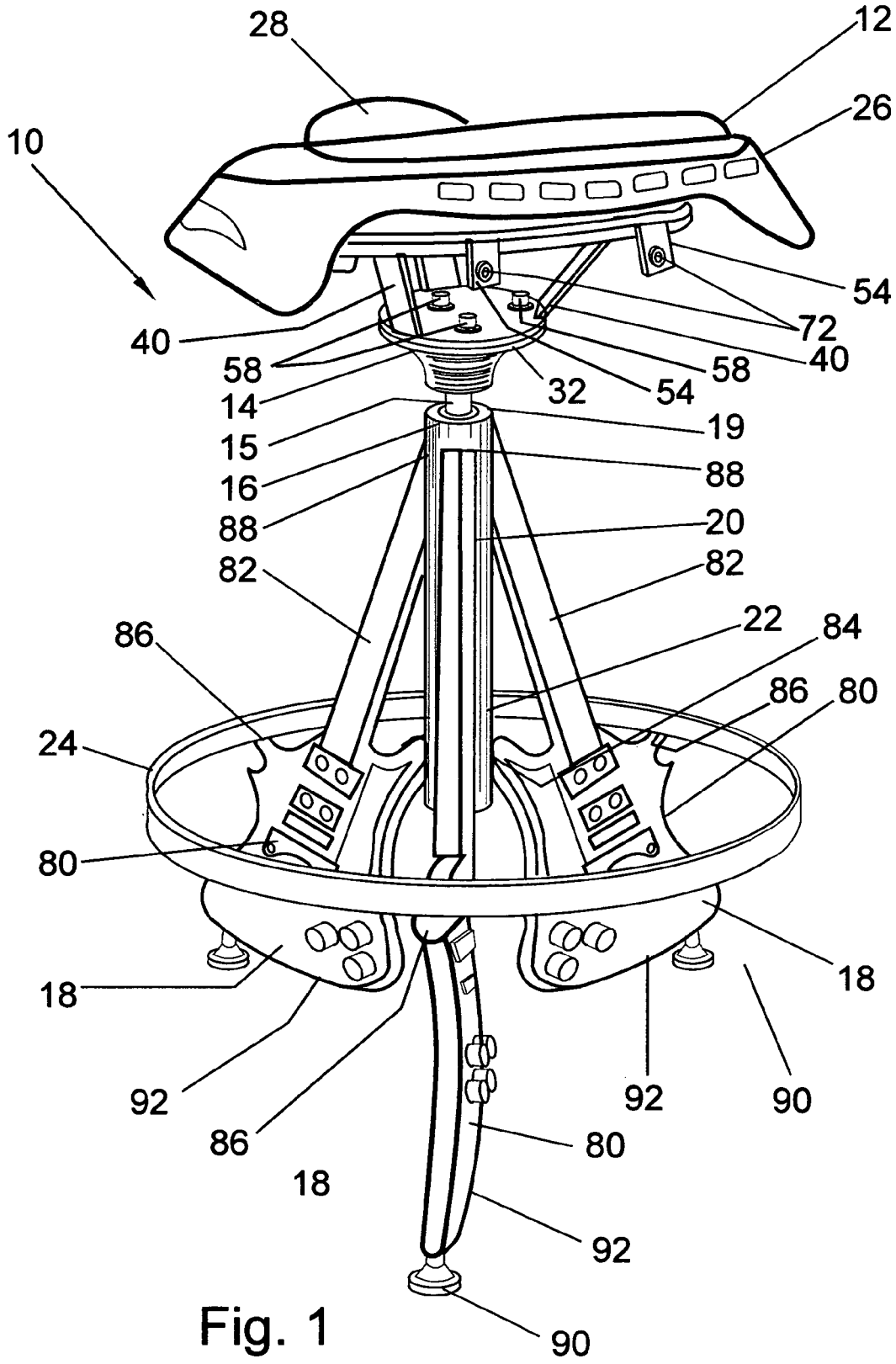
FIG. 1 illustrates a perspective view of a stool according to an embodiment of the invention.
Figure 2:
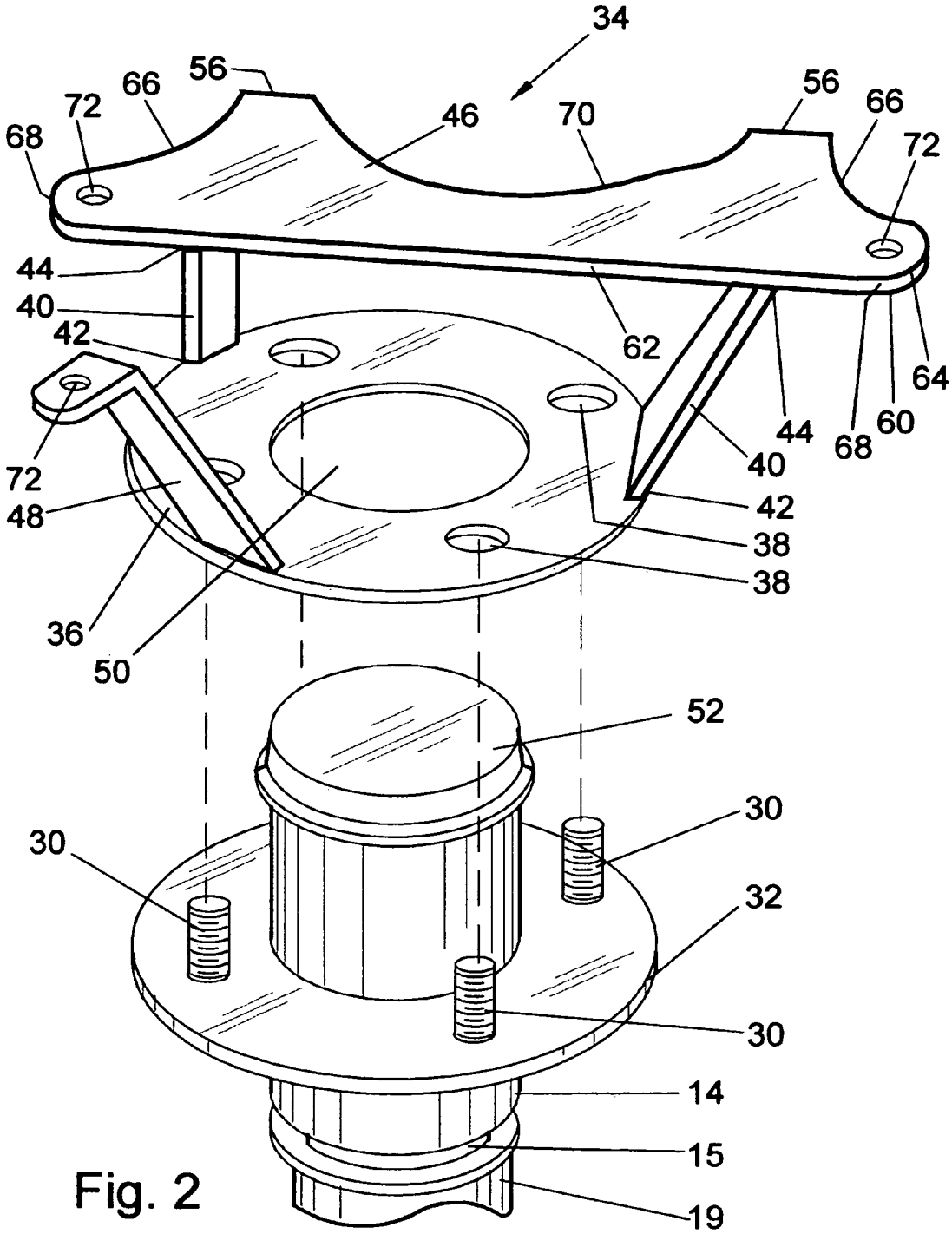
FIG. 2 illustrates an exploded perspective view of a rotatable seat element and a bracket according to an embodiment of the invention.
Figure 3:
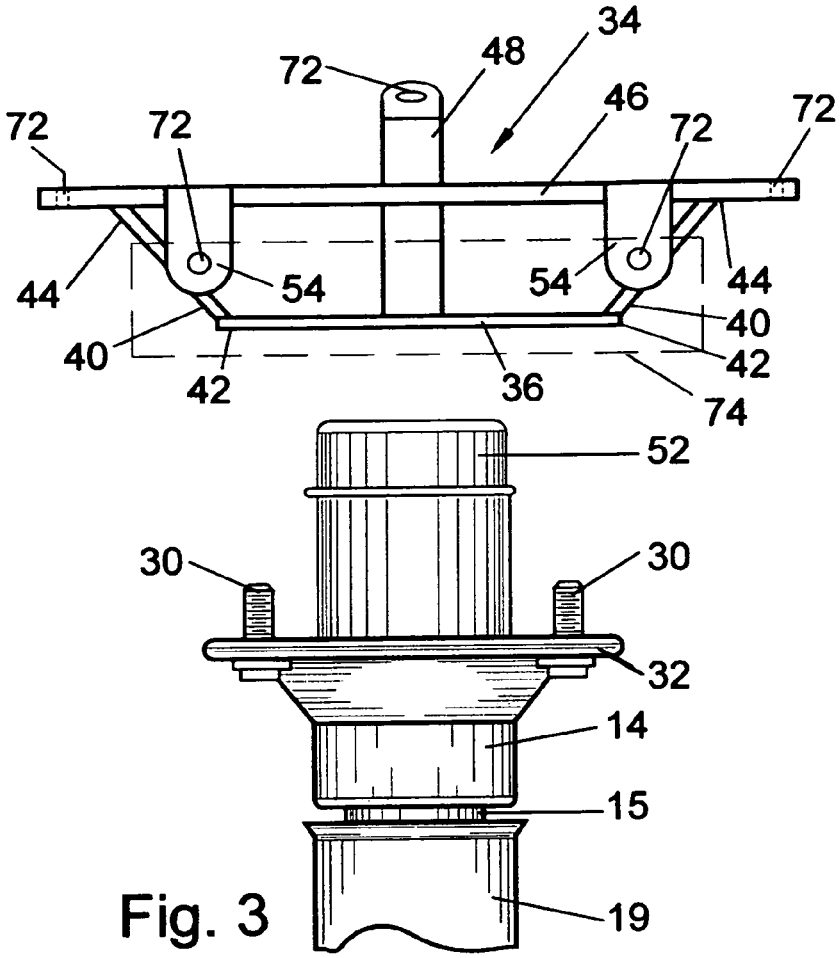
FIG. 3 illustrates an elevation view of a rotatable seat element and bracket according to an embodiment of the invention.
Figure 4:
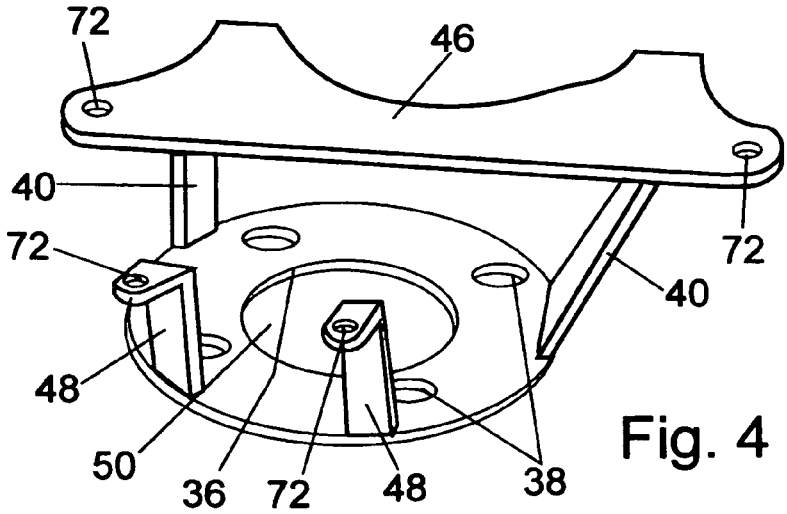
FIG. 4 illustrates a perspective view of a bracket with two auxiliary support beams according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 1 through 4, a stool 10 may have a seat 12 attached to a bracket 34 that is attached to a rotatable seat element 14 that has a central shaft 15 that is attached at a top end 19 of a central pedestal 16 that may have three or more legs 18 attached to a middle portion 20 and bottom portion 22 of the pedestal 16. The legs 18 may be splayed outwardly and equidistantly in a radial sense. A generally annular footrest 24 may be arranged around the pedestal 16 and may be attached to each of the legs 18.

The rotatable seat element 14 may be a wheel hub structure and the drawings illustrate a trailer vehicle hub that typically has four mounting bolts 30. A trailer vehicle hub may be a relatively rigid device with quality bearings that is relatively compact; however, other types of wheel hubs may be used. The wheel hub normally has an annular metal plate 32 to which the mounting bolts 30 are attached. This hub structure is a good platform for attaching a bracket 34 using fastening nuts 58.

The bracket 34 may have a generally circular metal plate 36 with bolt holes 38 positioned to slide over mounting bolts 30. There may be two generally vertical support beams 40 attached at a first end 42 to the plate 36 and at a second end 44 to a seat mounting plate 46 that may generally be shaped to support the type of seat 12 to be attached to the rotatable seat element 14 of the stool 10. Other support beams such as an auxiliary support beam 48 that may have one or more attachment holes 72 may be attached to plate 36 as necessary to support a particular design seat 12. The Figures illustrate a saddle type seat 12 attached to the bracket 34. There may be a rotatable element hole 50 centered in plate 36 in the case of an upward extending hub element 52 of the element 14.

The seat mounting plate 46 may have one or more attachment brackets 54 for use in attaching a particular type of seat 12. The Figures illustrate two attachment brackets 54 extending downwardly at an outer edge 56 for attachment of the rear portion 26 of the saddle seat 12. The auxiliary support beam 48 may be used to attach the front portion 28 of the saddle seat 12. The seat mounting plate 46 may have a perimeter edge 60 with a generally straight forward edge 62. The rear edge 64 may have concave edges 66 between the ends 68 and the outer edges 56 and may have a concave edge 70 between the outer edges 56. There may be attachment holes 72 formed in the seat mounting plate 46 that are positioned for attachment of a particular design of a seat. The illustrated configuration for the seat mounting plate 46 is useful for mounting a variety of seats 12 including the saddle seat illustrated.

Figure 5:
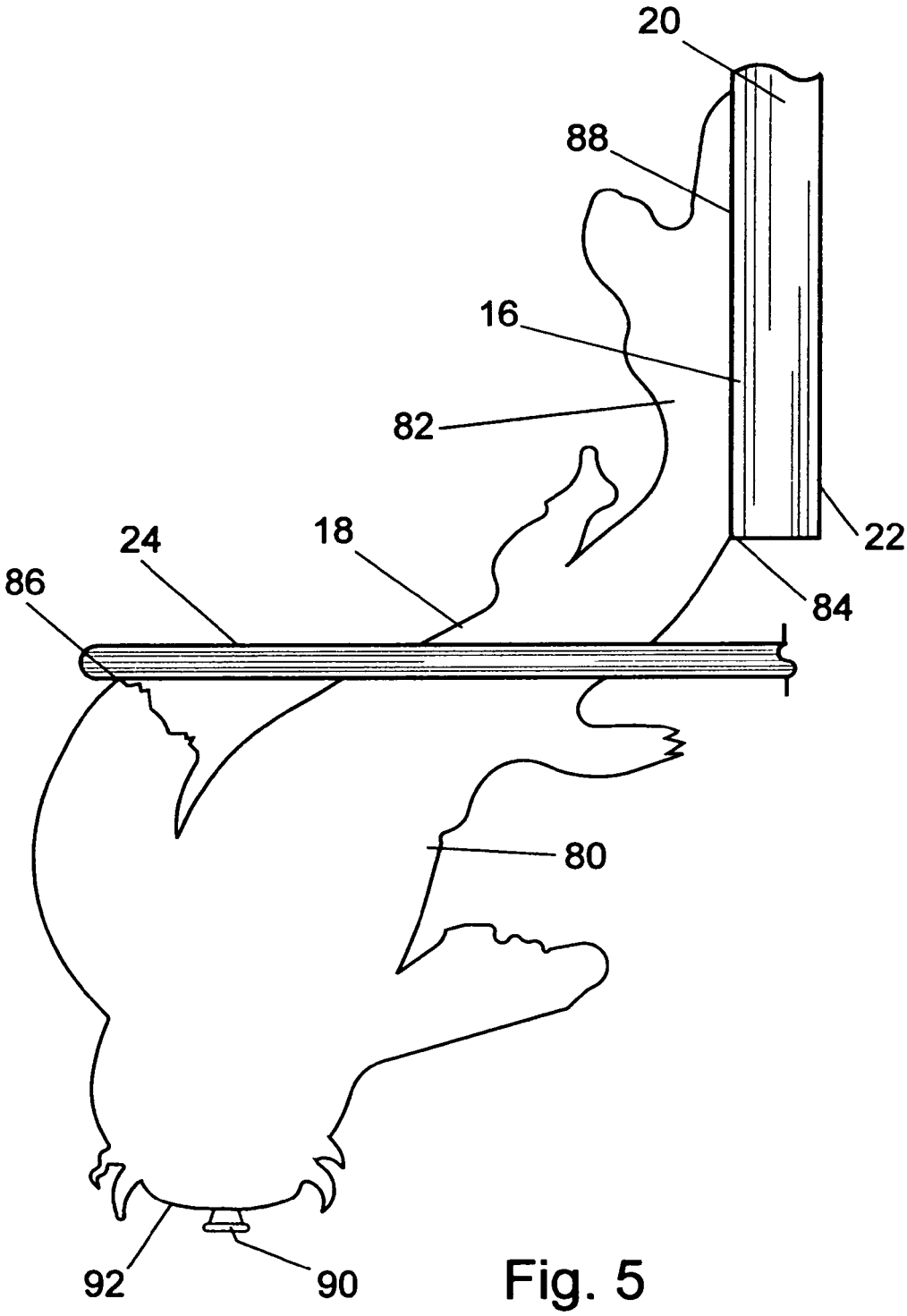
FIG. 5 illustrates a side elevation view of a leg according to an embodiment of the invention.

The legs 18 may be designed as aesthetic objects, for example, the general structure of a guitar or other instrument, the shapes of animals or portions of animals, for example, a dolphin leg is illustrated in FIG. 5, and other artistic forms. The legs 18 for the disclosure description are in the form of a guitar. The guitar legs 18 have a body 80 with a long neck 82. The body 80 is attached at a first edge 84 to the bottom 22 of the central pedestal 16 and at a second edge 86 to the annular footrest 24. The upper end 88 of the neck 82 is attached to the middle portion 20 of the central pedestal 16. There may be a foot element 90 extending downwardly at a lower edge 92 of the body 80.

While the invention has been particularly shown and described with respect to the illustrated embodiments thereof, it will be understood by those skilled in the art that the foregoing and other changes in form and details may be made therein without departing from the spirit and scope of the invention.

I claim:

1. A stool structured for attachment of a variety of seats and legs comprising:

a bracket with a generally circular metal plate that has a plurality of bolt apertures disposed therein and a rotatable seat element with a plurality of mounting bolts for receipt in the plurality of bolt apertures;

a support beam that extends upwardly is attached at a first end to said circular metal plate and at a second end to a seat mounting plate;

a plurality of fasteners are fastened to said plurality of mounting bolts that are inserted through said plurality of bolt apertures;

a central pedestal has a central shaft of said rotatable seat element attached at a top end;

a plurality of legs are attached at an upper end to a middle portion of said central pedestal and at a first edge to a bottom portion of said central pedestal; and a generally annular footrest is arranged around said central pedestal and is attached to a second edge of said plurality of legs that are splayed outwardly and generally equidistant radially around said central pedestal.

2. The stool as in claim 1 wherein:

said rotatable seat element is a wheel hub that has a generally annular metal plate orthogonal to said central shaft and said plurality of mounting bolts are attached to said annular metal plate; and said circular metal plate has a centrally disposed aperture for an upward extending hub element to extend through.

3. The stool as in claim 1 wherein said support beam is two spaced apart generally vertical support beams.

4. The stool as in claim 1 wherein an attachment bracket having an attachment aperture therein is attached to an outer edge of said seat mounting plate.

5. The stool as in claim 1 wherein said seat mounting plate has a perimeter edge with a generally straight forward edge and a rear edge with a concave edge between each end and a pair of outer edges that have a concave edge between said outer edges.

6. The stool as in claim 1 wherein there are a plurality of attachment apertures in said seat mounting plate.

7. The stool as in claim 1 wherein said plurality of legs are shaped in the form of a guitar with a body and a long neck with said upper end at a top of said long neck and said first edge and said second edge are opposed edges on an upper edge of said body.

8. The stool as in claim 7 wherein a foot element is attached and extends downwardly from a lower edge of said body.

9. The stool as in claim 1 wherein there is an auxiliary support beam attached at one end to said circular metal plate and extends upwardly from said circular metal plate.

10. The stool as in claim 9 wherein a saddle seat is attached at a rear portion to said seat mounting plate and at a front portion to said auxiliary support beam.

* * * * *